US012116541B2

(12) United States Patent
Wagner et al.

(10) Patent No.: US 12,116,541 B2
(45) **Date of Patent: *Oct. 15, 2024**

(54) EMULSIFIER PACKAGE WITH A SHORT-CHAINED AND OPTIONALLY WITH A LONG-CHAINED SURFACTANT FOR FUEL EMULSION

(71) Applicant: BASF SE, Ludwigshafen am Rhein (DE)

(72) Inventors: Jochen Wagner, Rheinland-Pfalz (DE); Marcel Harhausen, Rheinland-Pfalz (DE); Thorsten Schoeppe, Rheinland-Pfalz (DE); Simon Steppan, Rheinland-Pfalz (DE); Jens Meissner, Rheinland-Pfalz (DE)

(73) Assignee: BASF SE

( * ) Notice: Subject to any disclaimer, the term of this patent is extended or adjusted under 35 U.S.C. 154(b) by 0 days.

This patent is subject to a terminal disclaimer.

(21) Appl. No.: 18/251,709

(22) PCT Filed: Oct. 26, 2021

(86) PCT No.: PCT/EP2021/079634

§ 371 (c)(1),
(2) Date: May 3, 2023

(87) PCT Pub. No.: WO2022/096316

PCT Pub. Date: May 12, 2022

(65) Prior Publication Data

US 2024/0002740 A1 Jan. 4, 2024

(30) Foreign Application Priority Data

Nov. 4, 2020 (EP) ..... 20205715
Nov. 11, 2020 (EP) ..... 20207010

(51) Int. Cl.
*C10L 1/32* (2006.01)
*C10L 1/12* (2006.01)
*C10L 1/185* (2006.01)

(52) U.S. Cl.
CPC ..... *C10L 1/328* (2013.01); *C10L 1/125* (2013.01); *C10L 1/1852* (2013.01); *C10L 2250/082* (2013.01); *C10L 2270/026* (2013.01)

(58) Field of Classification Search
CPC ..... C10L 1/125; C10L 1/1852; C10L 1/1986; C10L 1/328; C10L 2200/0438; C10L 2200/0446; C10L 2230/04; C10L 2250/08; C10L 2250/082; C10L 2270/026; C10L 2290/24; G06F 16/284
See application file for complete search history.

(56) References Cited

U.S. PATENT DOCUMENTS

| | | | | |
|---|---|---|---|---|
| 4,388,893 | A | 6/1983 | Apfel | |
| 8,875,666 | B2 | 11/2014 | Strey et al. | |
| 2004/0107633 | A1 | 6/2004 | Schulz et al. | |
| 2017/0349848 | A1* | 12/2017 | Pavageau | C10L 1/324 |
| 2022/0119577 | A1* | 4/2022 | Dhawan | C08G 8/28 |

FOREIGN PATENT DOCUMENTS

| | | | |
|---|---|---|---|
| DE | 19747240 | A1 | 7/1998 |
| DE | 19747247 | A1 | 7/1998 |
| EP | 0242832 | A2 * | 10/1987 |
| EP | 0937768 | A2 | 8/1999 |
| WO | WO-90/12959 | A1 | 11/1990 |
| WO | WO-00/53916 | A1 | 9/2000 |
| WO | WO-2010/105620 | A1 | 9/2010 |
| WO | WO-2010/145652 | A1 | 12/2010 |
| WO | WO-2011/042432 | A1 | 4/2011 |
| WO | WO-2013/035894 | A1 | 3/2013 |
| WO | WO-2016/064722 | A1 | 4/2016 |

OTHER PUBLICATIONS

EP0242832A2 Google Translation (Year: 1987).*
Asgar Kayan, "Synthesis of poly(styrene oxide) with different molecular weights using tin catalysts", Designed Monomers and Polymers, vol. 18, Issue 6, 2015, pp. 545-549.
International Search Report for PCT Patent Application No. PCT/EP2021/079634, Issued on Jan. 5, 2022, 4 pages.
International Preliminary Report on Patentability for PCT Patent Application No. PCT/EP2021/079634, Issued on Jan. 19, 2023, 14 pages.
Written Opinion for PCT Patent Application No. PCT/EP2021/079634, Issued on Jan. 5, 2022, 7 pages.

* cited by examiner

*Primary Examiner* — Ellen M McAvoy
*Assistant Examiner* — Chantel Graham
(74) *Attorney, Agent, or Firm* — Grüneberg and Myers PLLC

(57) ABSTRACT

A method for powering a diesel engine with a fuel emulsion involves preparing the fuel emulsion by emulsifying a fuel and water in the presence of an emulsifier package, which contains a short-chained surfactant of the formula (I) as defined below and optionally, a long-chained surfactant of the formula (II) as defined below. A fuel emulsion for powering a diesel engine is also provided.

20 Claims, No Drawings

EMULSIFIER PACKAGE WITH A SHORT-CHAINED AND OPTIONALLY WITH A LONG-CHAINED SURFACTANT FOR FUEL EMULSION

CROSS-REFERENCE TO RELATED APPLICATIONS

This application is the National Stage entry under § 371 of International Application No. PCT/EP2021/079634, filed on Oct. 26, 2021, and which claims the benefit of priority to European Application No. 20205715.4, filed on Nov. 4, 2020, and to European Application Ser. No. 20/207,010.8, filed on Nov. 11, 2020. The content of each of these applications is hereby incorporated by reference in its entirety.

The present invention relates to a method for powering a diesel engine with a fuel emulsion comprising the step of preparing the fuel emulsion by emulsifying a fuel and water in the presence of an emulsifier package which comprises a short-chained surfactant of the formula (I) as defined below and optionally a long-chained surfactant of the formula (II) as defined below. It further relates to a fuel emulsion for powering a diesel engine.

Aqueous fuel emulsions are known for powering diesel engines.

Object of the present invention was to find an emulsifier package for fuel emulsions, which is cheap, easy to prepare, storage stable, based on commercial available emulsifiers, based only on carbon, hydrogen, nitrogen and oxygen, and allow for fast and easy emulsification even with low shear forces. The emulsifier package should result in a low foaming fuel emulsion, it should have a low cloud point, provide corrosion protection, have low foaming, improve filterability of the emulsion, and reduce precipitate when mixing the fuel with water. The emulsifier package should stabilize the fuel emulsion at high water concentrations, at various temperatures and pressures, with various types of water.

The object was achieved by a method for powering a diesel engine with a fuel emulsion comprising the step of preparing the fuel emulsion by emulsifying a fuel and water in the presence of an emulsifier package which comprises a short-chained surfactant of the formula (I)

$$R^a—O-(AO^a)_m—R^{a'} \quad (I)$$

in which $R^a$ is a linear or branched $C_{6-14}$ alkyl, $AO^a$ is an ethylene oxide radical, propylene oxide radical, butylene oxide radical, pentylene oxide radical, styrene oxide radical or mixtures thereof, m is a number from 1 to 100, and $R^a$ is hydrogen or $C_{1-4}$ alkyl.

The object was also achieved by the fuel emulsion for powering a diesel engine.

The fuel usually comprises hydrocarbons, such as alkanes, cycloalkanes and aromatics. The fuel may be obtained from petroleum distillation as distillate or residue. The fuels is usually a liquid fuel. Examples of fuels are gasoline, diesel or biodiesel or mixtures thereof, wherein gasoline or diesel are preferred. In particular the fuel is diesel. The gasoline may contain mainly C4 to C12 hydrocarbons of alkanes, alkenes and cycloalkanes. The diesel may contain saturated hydrocarbons and aromatic hydrocarbons. The biodiesel typically includes lower alkyl fatty acid esters, prepared, for example, by transesterifying trigycerides with lower alcohols, e.g. methanol or ethanol.

The viscosity of the fuel can vary in a broad range, such as in the range from 1 to 10,000 $mm^2/s$ at 40° C. (ISO 3104) or 1 to 1000 $mm^2/s$ at 50° C. (ISO 3104).

The fuel may be a marine fuel, such as MGO (Marine gas oil), MDO (Marine diesel oil), IFO (Intermediate fuel oil), MFO (Marine fuel oil), or HFO (Heavy fuel oil). Further examples for marine fuel are IFO 380 (an Intermediate fuel oil with a maximum viscosity of 380 centistokes (<3.5% sulphur)), IFO 180 (an Intermediate fuel oil with a maximum viscosity of 180 centistokes (<3.5% sulphur)), LS 380 (a Low-sulphur (<1.0%) intermediate fuel oil with a maximum viscosity of 380 centistokes), LS 180 (a Low-sulphur (<1.0%) intermediate fuel oil with a maximum viscosity of 180 centistokes), LSMGO (a Low-sulphur (<0.1%) Marine Gas Oil, which is often be used in European Ports and Anchorages according to EU Sulphur directive 2005/33/EC), or ULSMGO (a Ultra-Low-Sulphur Marine Gas Oil, also referred to as Ultra-Low-Sulfur Diesel (sulphur 0.0015% max). Further suitable marine fuels are according to DIN ISO 8217 of the category ISO-F-DMX, DMA, DFA, DMZ, DFZ, or DFB, or ISO-F RMA, RMB, RMD, RME, RMG, or RMK. Further suitable marine fuel is distillate marine diesel or residual marine diesel.

The viscosity of the fuel, such as the marine fuel, can vary in a broad range, such as in the range from 1 to 10,000 $mm^2/s$ at 40° C. (ISO 3104) or 1 to 1000 $mm^2/s$ at 50° C. (ISO 3104).

The fuel emulsion may contain at least 10, 20, 25, 30, 35, 40, 50 or 60 wt % of the fuel. The fuel emulsion may contain up to 30, 40, 50 or 60 wt % of the fuel. The fuel emulsion may contain 10 to 70 wt %, 20 to 60 wt %, or 30 to 50 wt % of the fuel.

For ecological reasons low sulfur fuel are of increasing interest. Suitable low sulfur fuels may contain less than 1, 0.5, 0.2, or 0.1 wt % sulfur. An example is Shell@ ULSFO with less than 0.1 wt % sulfur. The diesel mainly used for cars may have a sulfur content of up to 2000 ppm, 500 ppm, 350 ppm, 50 ppm or 10 ppm.

Any kind of water can be used, such as tap water, well water, sea water, oceanic water, rain water, distilled water, waste water, or deionized water. Preferred is water with low chlorine concentration to avoid corrosion, such as tap water, distilled water or rain water.

The water may have a low hardness, e.g. as expressed by ° dH (degree of German hardness) below 8.4° dH, or a concentration of less than 1.5 mmol/l calcium carbonate.

The water may have a low salinity, such as up to 1000, 500, 100, 10, or 1 ppmw, e.g. based on the concentration of NaCl.

The fuel emulsion may contain at least 10, 20, 30, 40, 50, 55, 60, 65 or 70 wt % of the water. The fuel emulsion may contain up to 50, 60, 70, 75, 80, 85 or 90 wt % of the water. The fuel emulsion may contain 30 to 90 wt %, 40 to 80 wt %, or 50 to 80 wt % of the water.

The weight ratio of the water to the fuel can be in the range of 1:0.1 to 1:10, or 1:0.2 to 1:5, or 1:0.7 to 1:3, or preferably 1:0.1 to 1:1

The fuel emulsion can be an oil-in-water emulsion or a water-in-oil emulsion, where the oil-in-water emulsion is preferred.

The fuel emulsion may be a macroemulsion, miniemulsion or microemulsion, where the macroemulsion is preferred.

The dispersed phase (e.g. the fuel) in the fuel emulsion may have a diameter of 0.01 to 100 μm, preferably from 1 to 100 μm.

The fuel emulsion may be present at a temperature from 0 to 100° C., preferably from 15 to 90° C.

The fuel emulsion may be present at a pressure from 1 to 100 bar, preferably from 1 to 10 bar.

The emulsifier package comprises a short-chained surfactant of the formula (I)

$$R^a—O—(AO^a)_m—R^{a'} \quad (I)$$

in which $R^a$ is a linear or branched $C_{6-14}$ alkyl, $AO^a$ is an ethylene oxide radical, propylene oxide radical, butylene oxide radical, pentylene oxide radical, styrene oxide radical or mixtures thereof, m is a number from 1 to 100, and $R^{a'}$ is hydrogen or $C_{1-4}$ alkyl.

$R^a$ is preferably a linear or branched $C_{10-14}$ alkyl. In another preferred form $R^a$ is a linear or branched $C_{12-14}$ alkyl. In another preferred form $R^a$ is a linear or branched $C_{10-14}$ alkyl.

In another form $R^a$ is preferably a branched $C_{8-14}$ alkyl. In another preferred form $R^a$ is a branched $C_{10-14}$ alkyl. In another preferred form $R^{a\ iS}$ a branched $C_{12-14}$ alkyl. $R^a$ is in particular a branched $C_{13}$, such as isotridecyl.

Suitable branched alkyl for $R^a$ are for example iso-hexyl-, iso-octyl, such as for example 2-ethyl-hexyl, isononyl, iso-decyl such as trimethyl heptyl or 2-propylheptyl. $R^a$ may be a technical mixture of various chain lengths and isomers.

$AO^a$ can be an ethylene oxide radical, propylene oxide radical, butylene oxide radical, or mixtures thereof. $AO^a$ is preferably an ethylene oxide radical. In another preferred form $AO^a$ is a mixture of an ethylene oxide radical and a propylene oxide radical. The alkoxy units (e.g. EO and PO units) of $AO^a$ can be in a block sequence or in statistically sequence, preferably in a diblock sequence. The molar ratio of ethylene oxide radical to other alkylene oxide radicals present in $AO^a$ (e.g. propylene oxide radical) can be in the range of 50:1 to 1:2, or 10:1 to 1:1, or 5:1 to 1:1.

m can be a number from 1 to 80, 2 to 80, or 3 to 60. In another form m can be a number from 1 to 30, 1 to 25, 1 to 20, 1 to 15, or 1 to 10. In another form m can be a number from 2 to 25, 2 to 15, 3 to 15, or 3 to 10. In another form m can be a number from 15 to 100, 20 to 70, or 25 to 60. In another form m is at least 1, 2, 3, 5, 10, 15, 20, 25 or 30. In another form m is up to 80, 70, 60, 50, 40, 30, 20, 15, 10, 5.

$R^{a'}$ can be hydrogen or methyl, preferably hydrogen.

In a preferred form $R^a$ is a linear or branched $C_{8-14}$ alkyl, $AO^a$ is an ethylene oxide radical, propylene oxide radical, or mixtures thereof, m is a number from 2 to 25 and $R^{a'}$ is hydrogen or methyl.

In another preferred form $R^a$ is a linear or branched $C_{10-14}$ alkyl, $AO^a$ is an ethylene oxide radical, propylene oxide radical, or mixtures thereof, m is a number from 2 to 15 and $R^{a'}$ is hydrogen.

In a preferred form $R^a$ is a branched $C_{10-14}$ alkyl (such as isotridecyl), $AO^a$ is an ethylene oxide radical, m is a number from 2 to 25 and $R^{a'}$ is hydrogen or methyl.

In a preferred form $R^a$ is a linear or branched $C_{8-14}$ alkyl, $AO^a$ is an ethylene oxide radical, propylene oxide radical, or mixtures thereof, m is a number from 2 to 80 and $R^{a'}$ is hydrogen or methyl.

In another preferred form $R^a$ is a linear or branched $C_{10-14}$ alkyl, $AO^a$ is an ethylene oxide radical, propylene oxide radical, or mixtures thereof, m is a number from 2 to 70 and $R^{a'}$ is hydrogen.

In a preferred form $R^a$ is a branched $C_{10-14}$ alkyl (such as isotridecyl), $AO^a$ is an ethylene oxide radical, m is a number from 20 to 60 and $R^{a'}$ is hydrogen or methyl.

The emulsifier package comprises in a preferred form additionally a long-chained surfactant of the formula (II)

$$R^b—O—(AO^b)_n—R^{b'} \quad (II)$$

in which $R^b$ is a linear or branched $C_{16-32}$ alkyl, $AO^b$ is an ethylene oxide radical, propylene oxide radical, butylene oxide radical, pentylene oxide radical, styrene oxide radical or mixtures thereof, n is a number from 1 to 30 and $R^{b'}$ is hydrogen or $C_{1-4}$ alkyl.

The emulsifier package comprises in another preferred form the short-chained surfactant of the formula (I) and the long-chained surfactant of the formula (II).

$R^b$ is preferably a linear or branched $C_{16-22}$ alkyl. In another preferred form $R^b$ is a linear or branched $C_{16-18}$ alkyl. In another preferred form $R^b$ is linear $C_{16-22}$ alkyl. In another preferred form $R^b$ is a linear $C_{16-18}$ alkyl. $R^b$ may be a technical mixture of various chain lengths and isomers.

$AO^b$ can be an ethylene oxide radical, propylene oxide radical, butylene oxide radical, or mixtures thereof. $AO^b$ is preferably an ethylene oxide radical. In another preferred form $AO^b$ is a mixture of an ethylene oxide radical and a propylene oxide radical. The alkoxy units (e.g. EO and PO units) of $AO^b$ can be in a block sequence or in statistically sequence, preferably in a diblock sequence. The molar ratio of ethylene oxide radical to other alkylene oxide radicals present in $AO^b$ (e.g. propylene oxide radical) can be in the range of 50:1 to 1:2, or 10:1 to 1:1, or 5:1 to 1:1.

n can be a number from 1 to 80, 2 to 80, or 3 to 60. In another form n can be a number from 1 to 30, 1 to 25, 1 to 20, 1 to 15, or 1 to 10. In another form n can be a number from 2 to 25, 2 to 15, 3 to 15, or 3 to 10. In another form n can be a number from 15 to 100, 20 to 70, or 25 to 60. In another form n is at least 1, 2, 3, 5, 10, 15, 20, 25 or 30. In another form n is up to 80, 70, 60, 50, 40, 30, 20, 15, 10, 5.

$R^{b'}$ can be hydrogen or methyl, preferably hydrogen. Preferably, $R^{a'}$ and $R^{b'}$ are hydrogen.

In a preferred form $R^b$ is a linear $C_{14-18}$ alkyl, $AO^b$ is a mixture of ethylene oxide radical and propylene oxide radical, n is a number from 1 to 25 and $R^{b'}$ is hydrogen or methyl.

In another preferred form $R^b$ is a linear $C_{16-18}$alkyl, $AO^b$ is a mixture of ethylene oxide radical and propylene oxide radical, n is a number from 1 to 15 and $R^{b'}$ is hydrogen.

In another preferred form $R^b$ is a linear $C_{14-18}$ alkyl, $AO^b$ is a mixture of ethylene oxide radical and propylene oxide radical, n is a number from 1 to 80 and $R^{b'}$ is hydrogen or methyl.

In another preferred form $R^b$ is a linear $C_{16-18}$ alkyl, $AO^b$ is a mixture of ethylene oxide radical and propylene oxide radical, n is a number from 2 to 60 and $R^{b'}$ is hydrogen.

In another preferred form $R^a$ is a linear or branched $C_{8-14}$ alkyl, $AO^a$ is an ethylene oxide radical, propylene oxide radical, or mixtures thereof, m is a number from 2 to 25 and $R^{a'}$ is hydrogen or methyl, and $R^b$ is a linear $C_{14-18}$ alkyl, $AO^b$ is a mixture of ethylene oxide radical and propylene oxide radical, n is a number from 1 to 25 and $R^{b'}$ is hydrogen or methyl.

In another preferred form $R^a$ is a linear or branched $C_{10-14}$ alkyl, $AO^a$ is an ethylene oxide radical, propylene oxide radical, or mixtures thereof, m is a number from 2 to 15 and $R^{a'}$ is hydrogen, and $R^b$ is a linear $C_{16-18}$ alkyl, $AO^b$ is a mixture of ethylene oxide radical and propylene oxide radical, n is a number from 1 to 15 and $R^{b'}$ is hydrogen.

In another preferred form $R^a$ is a branched $C_{10-14}$ alkyl (such as isotridecyl), $AO^a$ is an ethylene oxide radical, m is a number from 2 to 25 and $R^{a'}$ is hydrogen or methyl, and $R^b$ is a linear $C_{16-18}$ alkyl, $AO^b$ is a mixture of ethylene oxide radical and propylene oxide radical, n is a number from 1 to 15 and $R^{b'}$ is hydrogen.

In another preferred form $R^a$ is a linear or branched $C_{8-14}$ alkyl, $AO^a$ is an ethylene oxide radical, propylene oxide radical, or mixtures thereof, m is a number from 2 to 25 and $R^{a'}$ is hydrogen or methyl, and $R^b$ is a linear $C_{14-18}$ alkyl, $AO^b$ is a mixture of ethylene oxide radical and propylene oxide radical, n is a number from 1 to 25 and $R^{b'}$ is hydrogen or methyl, and the emulsifier package comprises the short-chained surfactant and the long-chained surfactant in a weight ratio of 10:1 to 1:10, 4:1 to 1:4, or 2:1 to 1:2.

In another preferred form $R^a$ is a linear or branched $C_{10-14}$ alkyl, $AO^a$ is an ethylene oxide radical, propylene oxide radical, or mixtures thereof, m is a number from 2 to 15 and $R^{a'}$ is hydrogen, and $R^b$ is a linear $C_{16-18}$ alkyl, $AO^b$ is a mixture of ethylene oxide radical and propylene oxide radical, n is a number from 1 to 15 and $R^{b'}$ is hydrogen, and the emulsifier package comprises the short-chained surfactant and the long-chained surfactant in a weight ratio of 10:1 to 1:10, 4:1 to 1:4, or 2:1 to 1:2.

In another preferred form $R^a$ is a branched $C_{10-14}$ alkyl (such as isotridecyl), $AO^a$ is an ethylene oxide radical, m is a number from 2 to 25 and $R^{a'}$ is hydrogen or methyl, and $R^b$ is a linear $C_{16-18}$ alkyl, $AO^b$ is a mixture of ethylene oxide radical and propylene oxide radical, n is a number from 1 to 15 and $R^{b'}$ is hydrogen, and the emulsifier package comprises the short-chained surfactant and the long-chained surfactant in a weight ratio of 10:1 to 1:10, 4:1 to 1:4, or 2:1 to 1:2.

In another preferred form $R^a$ is a linear or branched $C_{8-14}$ alkyl, $AO^a$ is an ethylene oxide radical, propylene oxide radical, or mixtures thereof, m is a number from 1 to 80 and $R^{a'}$ is hydrogen or methyl, and $R^b$ is a linear $C_{14-18}$ alkyl, $AO^b$ is a mixture of ethylene oxide radical and propylene oxide radical, n is a number from 1 to 80 and $R^{b'}$ is hydrogen or methyl.

In another preferred form $R^a$ is a linear or branched $C_{10-14}$ alkyl, $AO^a$ is an ethylene oxide radical, propylene oxide radical, or mixtures thereof, m is a number from 2 to 80 and $R^{a'}$ is hydrogen, and $R^b$ is a linear $C_{16-18}$ alkyl, $AO^b$ is a mixture of ethylene oxide radical and propylene oxide radical, n is a number from 1 to 80 and $R^{b'}$ is hydrogen.

In another preferred form $R^a$ is a branched $C_{10-14}$ alkyl (such as isotridecyl), $AO^a$ is an ethylene oxide radical, m is a number from 15 to 80 and $R^{a'}$ is hydrogen or methyl, and $R^b$ is a linear $C_{16-18}$ alkyl, $AO^b$ is a mixture of ethylene oxide radical and propylene oxide radical, n is a number from 1 to 30 and $R^{b'}$ is hydrogen.

In another preferred form $R^a$ is a linear or branched $C_{8-14}$ alkyl, $AO^a$ is an ethylene oxide radical, propylene oxide radical, or mixtures thereof, m is a number from 1 to 80 and $R^{a'}$ is hydrogen or methyl, and $R^b$ is a linear $C_{14-18}$ alkyl, $AO^b$ is a mixture of ethylene oxide radical and propylene oxide radical, n is a number from 1 to 80 and $R^{b'}$ is hydrogen or methyl, and the emulsifier package comprises the short-chained surfactant and the long-chained surfactant in a weight ratio of 10:1 to 1:10, 4:1 to 1:4, or 2:1 to 1:2.

In another preferred form $R^a$ is a linear or branched $C_{10-14}$ alkyl, $AO^a$ is an ethylene oxide radical, propylene oxide radical, or mixtures thereof, m is a number from 2 to 80 and $R^{a'}$ is hydrogen, and $R^b$ is a linear $C_{16-18}$ alkyl, $AO^b$ is a mixture of ethylene oxide radical and propylene oxide radical, n is a number from 1 to 80 and $R^{b'}$ is hydrogen, and the emulsifier package comprises the short-chained surfactant and the long-chained surfactant in a weight ratio of 10:1 to 1:10, 4:1 to 1:4, or 2:1 to 1:2.

In another preferred form $R^a$ is a branched $C_{10-14}$ alkyl (such as isotridecyl), $AO^a$ is an ethylene oxide radical, m is a number from 20 to 70 and $R^{a'}$ is hydrogen or methyl, and $R^b$ is a linear $C_{16-18}$ alkyl, $AO^b$ is a mixture of ethylene oxide radical and propylene oxide radical, n is a number from 1 to 20 and $R^{b'}$ is hydrogen, and the emulsifier package comprises the short-chained surfactant and the long-chained surfactant in a weight ratio of 10:1 to 1:10, 4:1 to 1:4, or 2:1 to 1:2.

The emulsifier package may comprise the short-chained surfactant and the long-chained surfactant in a weight ratio of 20:1 to 1:20, or 10:1 to 1:10, 4:1 to 1:4, 3:1 to 1:3, or 2:1 to 1:2.

In another form the emulsifier package may comprise the short-chained surfactant and the long-chained surfactant in a weight ratio of 20:1 to 1:3, or 10:1 to 1:2, 4:1 to 1:1, or 4:1 to 2:1. In another form the emulsifier package may comprise the long-chained surfactant and the short-chained surfactant in a weight ratio of 20:1 to 1:3, or 10:1 to 1:2, 4:1 to 1:1, or 4:1 to 2:1.

The emulsifier package may comprise the short-chained surfactant and/or the long-chained surfactant in certain percentages by weight, which may be calculated based on the total amount of surfactants (e.g. the short-chained and the long-chained surfactants) present in the emulsifier package.

The emulsifier package may comprise at least 0.1, 0.5, 1, 2, 5, 10, 20, 30 or 40 wt % of the short-chained surfactant.

The emulsifier package may comprise up to 100, 90, 80, 70, 60, 50, 40, 30, 20, 10 or 5 wt % of the short-chained surfactant.

The emulsifier package may comprise 0.1 to 20 wt %, or 0.5 to 10 wt %, or 1 to 5 of the short-chained surfactant. In another form the emulsifier package may comprise 1 to 99 wt %, 5 to 90 wt %, 10 to 80 wt %, or 20 to 70 wt % of the short-chained surfactant.

The emulsifier package may comprise 0.1 to 20 wt %, or 0.5 to 10 wt %, or 1 to 5 of the short-chained surfactant, where $R^a$ is a branched $C_{8-14}$ alkyl, $AO^a$ is an ethylene oxide radical, m is a number from 2 to 25 and $R^{a'}$ is hydrogen or methyl.

The emulsifier package may comprise 0.1 to 20 wt %, or 0.5 to 10 wt %, or 1 to 5 of the short-chained surfactant, where $R^a$ is a branched $C_{10-14}$ alkyl (such as isotridecyl), $AO^a$ is an ethylene oxide radical, m is a number from 2 to 25 and $R^{a'}$ is hydrogen or methyl.

In another form the emulsifier package may comprise 1 to 99 wt %, 5 to 90 wt %, 10 to 80 wt %, or 20 to 70 wt % of the short-chained surfactant, where $R^a$ is a branched $C_{8-14}$ alkyl, $AO^a$ is an ethylene oxide radical, m is a number from 2 to 25 and $R^{a'}$ is hydrogen or methyl.

In another form the emulsifier package may comprise 1 to 99 wt %, 5 to 90 wt %, 10 to 80 wt %, or 20 to 70 wt % of the short-chained surfactant, where $R^a$ is a branched $C_{10-14}$ alkyl (such as isotridecyl), $AO^a$ is an ethylene oxide radical, m is a number from 2 to 25 and $R^{a'}$ is hydrogen or methyl.

The emulsifier package may comprise 0.1 to 20 wt %, or 0.5 to 10 wt %, or 1 to 5 of the short-chained surfactant, where $R^a$ is a branched $C_{8-14}$ alkyl, $AO^a$ is an ethylene oxide radical, m is a number from 2 to 80 and $R^{a'}$ is hydrogen or methyl.

The emulsifier package may comprise 0.1 to 20 wt %, or 0.5 to 10 wt %, or 1 to 5 of the short-chained surfactant, where $R^a$ is a branched $C_{10-14}$ alkyl (such as isotridecyl), $AO^a$ is an ethylene oxide radical, m is a number from 2 to 60 and $R^{a'}$ is hydrogen or methyl.

In another form the emulsifier package may comprise 1 to 99 wt %, 5 to 90 wt %, 10 to 80 wt %, or 20 to 70 wt % of the short-chained surfactant, where $R^a$ is a branched $C_{8-14}$ alkyl, $AO^a$ is an ethylene oxide radical, m is a number from 15 to 80 and $R^{a'}$ is hydrogen or methyl.

In another form the emulsifier package may comprise 1 to 99 wt %, 5 to 90 wt %, 10 to 80 wt %, or 20 to 70 wt % of the short-chained surfactant, where $R^a$ is a branched $C_{10-14}$ alkyl (such as isotridecyl), $AO^a$ is an ethylene oxide radical, m is a number from 20 to 60 and $R^{a'}$ is hydrogen or methyl.

The emulsifier package may comprise at least 0.1, 0.5, 2, 5, 10, 20, 30 or 40 wt % of the long-chained surfactant.

The emulsifier package may comprise up to 90, 80, 70, 60, 50, 40, 30, 20, 10 or 5 wt % of the long-chained surfactant.

The emulsifier package may comprise 0.1 to 20 wt %, or 0.5 to 10 wt %, or 1 to 5 of the long-chained surfactant. In another form the emulsifier package may comprise 1 to 99 wt %, 5 to 90 wt %, 10 to 80 wt %, or 20 to 70 wt % of the long-chained surfactant.

The emulsifier package may comprise at least 0.1, 0.5 or 2 wt % of the long-chained surfactant, where $R^b$ is a linear $C_{16-18}$ alkyl, $AO^b$ is a mixture of ethylene oxide radical and propylene oxide radical, n is a number from 1 to 15 and $R^{b'}$ is hydrogen or methyl.

The emulsifier package may comprise up to 70, 60, 50, 40, 30, 20, 10 or 5 wt % of the long-chained surfactant, where $R^b$ is a linear $C_{16-18}$ alkyl, $AO^b$ is a mixture of ethylene oxide radical and propylene oxide radical, n is a number from 1 to 15 and $R^{b'}$ is hydrogen.

In another form the emulsifier package may comprise 1 to 99 wt %, 5 to 90 wt %, 10 to 80 wt %, or 20 to 70 wt % of the long-chained surfactant, where $R^b$ is a linear $C_{16-18}$ alkyl, $AO^b$ is a mixture of ethylene oxide radical and propylene oxide radical, n is a number from 1 to 15 and $R^{b'}$ is hydrogen or methyl.

In another form the emulsifier package may comprise 1 to 99 wt %, 5 to 90 wt %, 10 to 80 wt %, or 20 to 70 wt % of the long-chained surfactant where $R^b$ is a linear $C_{16-18}$ alkyl, $AO^b$ is a mixture of ethylene oxide radical and propylene oxide radical, n is a number from 1 to 15 and $R^{b'}$ is hydrogen.

The emulsifier package may comprise at least 0.1, 0.5 or 2 wt % of the long-chained surfactant, where $R^b$ is a linear $C_{16-18}$ alkyl, $AO^b$ is a mixture of ethylene oxide radical and propylene oxide radical, n is a number from 1 to 80 and $R^{b'}$ is hydrogen or methyl.

The emulsifier package may comprise up to 70, 60, 50, 40, 30, 20, 10 or 5 wt % of the long-chained surfactant, where $R^b$ is a linear $C_{16-18}$ alkyl, $AO^b$ is a mixture of ethylene oxide radical and propylene oxide radical, n is a number from 1 to 80 and $R^{b'}$ is hydrogen.

In another form the emulsifier package may comprise 1 to 99 wt %, 5 to 90 wt %, 10 to 80 wt %, or 20 to 70 wt % of the long-chained surfactant, where $R^b$ is a linear $C_{16-18}$ alkyl, $AO^b$ is a mixture of ethylene oxide radical and propylene oxide radical, n is a number from 2 to 70 and $R^{b'}$ is hydrogen or methyl.

In another form the emulsifier package may comprise 1 to 99 wt %, 5 to 90 wt %, 10 to 80 wt %, or 20 to 70 wt % of the long-chained surfactant where $R^b$ is a linear $C_{16-18}$ alkyl, $AO^b$ is a mixture of ethylene oxide radical and propylene oxide radical, n is a number from 2 to 60 and $R^{b'}$ is hydrogen.

The emulsifier package may comprise at least 0.5, 2 or 5 wt % of the sum of the short-chained surfactant and the long-chained surfactant.

The emulsifier package may comprise up to 100, 90, 80, 70, 60, 50, 40, 30, 20, 15, or 10 wt % of the sum of the short-chained surfactant and the long-chained surfactant.

The emulsifier package may comprise 1 to 90 wt %, 1 to 60 wt %, 1 to 35 wt %, or 2 to 20 wt %, or 5 to 12 of the sum of the short-chained surfactant and the long-chained surfactant.

The emulsifier package may comprise further nonionic surfactants, such as alkoxylates which are different from the short-chained surfactant and from the long-chained surfactant, alkylglucosides and alkyl polygucosides, or partial esters (such as mono-, di- and triesters) of fatty acids with glycerine or sorbitan (such as glycerine monostearate, sorbitanmonooleat, sorbitantristearat).

Suitable alkoxylates which are different from the short-chained surfactant and from the long-chained surfactant are

- alkoxylated alkylphenols, such as ethoxylated nonylphenyl, ethoxylated dodecylphenyl, ethoxylated isotridecylphenol and the esters thereof, e.g. the acetates
- block-copolymers of ethyleneoxide and propyleneoxide,
- ethoxylated alkylglucosides and alkyl polygucosides,
- ethoxylated fatty amines,
- ethoxylated fatty acids,
- ethoxylated partial esters of fatty acids with glycerine or sorbitan, such as ethoxylated glycerine monostearate
- ethoxylates of vegetable oils or animal fats, such as corn oil ethoxylate, castor oil ethoxylate, tallow oil ethoxylate,
- ethoxylates of fatty amines or of fatty amides.

The emulsifier package contains usually up to 50, 40, 30, 20, 10, 5, or 1 wt % of a further nonionic surfactant. The emulsifier package contains usually at least to 1, 5, 10, 20, 30, or 40 wt % of a further nonionic surfactant.

In another form the emulsifier package is free of ethoxylated fatty acids. In another form the emulsifier package is free of fatty acid amides. In another form the emulsifier package is free of ethoxylated castor oil. In another form the emulsifier package is free of fatty acid amides, ethoxylated fatty acids and ethoxylated castor oil.

The emulsifier package is contains usually up to 10, 8, 5, 4, 3, 2 or 1 wt % of the sum of all ionic surfactants, e.g. an anionic or cationic surfactant. In another form the emulsifier package is free of any ionic surfactant. The emulsifier package is contains usually a lower weight amount of the sum of all ionic surfactants than the sum of branched surfactant and the propoxylated surfactant. The sum of the weight amount of the branched surfactant and the propoxylated surfactant is usually in a 1, 1.5, or 2 fold excess of the sum of all ionic surfactants.

The emulsifier package is usually an aqueous emulsifier package, that usually comprises water. The emulsifier package may comprise at least 1, 5, 10, 20, 30, 40, 50, 60, 70, 80, or 90 wt % of water, usually based on the total weight of the emulsifier package.

In another form the emulsifier package is essentially free of water and contains for example less than 10, 8, 6, 4, 2, 1 or 0.2 wt % water.

The emulsifier package is usually liquid, solid, or a gel at 20° C., preferably it is a liquid.

The emulsifier package may comprise an organic solvent, which is preferably miscible with water (e.g. at 20° C. in an amount of at least 10 wt %). Suitable organic solvents are ethers (e.g. glykol ether), ketones, or alcohols, where ether (especially glylkol ether) are preferred.

Preferred organic solvents are glykol ether, such as methyldiglykol, methyltriglykol, methyltetraglykol, butyltriglykol, butylglykol, butyldiglykol, and hexyldiglykol.

The emulsifier package may comprise up to 90, 80, 70, 60, 50, 40, 30, 20, 15, or 10 wt % of the organic solvent, such as the glykol ether.

The emulsifier package may comprise at least 1, 5, 10, 20, 30, 40, 50, 60, 70, 80, or 90 wt % of the organic solvent, usually based on the total weight of the emulsifier package.

The emulsifier package may comprise 0.5 to 30 or 1 to 15 wt % of the organic solvent, such as the glykol ether.

In another form the emulsifier package may comprise water, the organic solvent, or a mixture of water and the organic solvent. In another form the emulsifier package may comprise at least 1, 5, 10, 20, 30, 40, 50, 60, 70, 80, or 90 wt % of water, the organic solvent, or a mixture of water and the organic solvent.

The fuel or the emulsifier package may comprise further additives, such as carrier oils, cold flow improvers, lubricity improvers, corrosion inhibitors, dehazers, antifoams, cetane number improvers, combustion improvers, antioxidants or stabilizers, antistats, metallocenes, metal deactivators, and/or dyes. The fuel or the emulsifier package may comprise up to 50, 30, 10, 5, or 1 wt % of further additives. In another form the emulsifier package may be free of further additives.

The fuel emulsion comprises the emulsifier package in an amount of up to 5, 3, 2, 1, 0.8, 0.6, 0.4, or 0.3 wt % based on the diesel.

The fuel emulsion comprises the emulsifier package in an amount of 0.001 to 1.0 wt %, 0.01 to 0.5 wt %, 0.01 to 0.4 wt %, or 0.05 to 0.3 wt % based on the diesel.

The fuel emulsion comprises the emulsifier package in an amount of up to 2, 1, 0.5, 0.2, 0.1, 0.08 wt % based on the fuel emulsion.

The fuel emulsion comprises the emulsifier package in an amount of 0.001 to 0.5, 0.005 to 0.4, 0.005 to 0.15, or 0.02 to 0.08 wt % based on the fuel emulsion.

The powering of a diesel engine with a fuel emulsion is known. Suitable diesel engines are for example a large turbocharged two-stroke diesel engine (e.g. as described in WO 2010/145652 or WO 2010/105620) or a two-strock diesel engine (e.g. as described in DE 19747247 or DE 19747240). The diesel engine may be used for stationary land engines (generators), railroad locomotives, cars, trucks, river ships, or ocean ships. The large two-stroke diesel engines may be used as prime mover in power plants or in ocean ships.

The emulsifying of the fuel and the water may be achieved by application of mechanical shear energy, e.g. in a stirred vessel, milling aggregates (like ball mills or stirred ball mills), shaking, rotor stator mixing, the turbulent flow through a pipe conveyed by pumps or by gravity, static mixers and counter current flow mixers. The emulsifying of the fuel and the water may also be achieved by a circulating the fuel and the water through a loop, e.g. by pumping them from the bottom of a tank to the top of the tank, where they are dumped on the surface of the tank content. Prior to the circulating of the fuel and the water a pre-stirring is possible, but not required.

The emulsifier package may contain different components. For emulsifying the fuel and the water some components may be added to the fuel and some components may be added to the water prior to emulsifying. Thus, the different components of the emulsifier package may be combined during the preparing of the fuel emulsion. Preferably, all components of the emulsifier package are premixed prior to emulsifying. Preferably, all components of the emulsifier package are added at the same time to the fuel or the water prior to emulsifying. The present invention may also relate to a fuel for powering a diesel engine with a fuel emulsion where the water comprises the emulsifier package.

The emulsifying can be made at temperatures of 0 to 100° C., or 10 to 90° C., or 20 to 50° C.

The emulsifying can be made at pressures of 0.5 to 20 bar, or 1 to 10 bar.

The time between the preparation of the fuel emulsion and its combustion in the diesel engine may be below 24 h, 6 h, 1 h, 45 min, 30 min, 15 min, 10 min, 5 min or 1 min.

Various devices for emulsifying the fuel and the water in diesel engines are known, for example from WO 2016/064722, WO 90/12959, U.S. Pat. No. 4,388,893, or WO 00/53916.

EXAMPLES

The emulsifier packages were prepared by mixing the emulsifiers and distilled water as indicated in Table 1 and an aqueous solution of emulsifiers was obtained.

The samples for testing the emulsion stability were prepared by mixing the additive package with diesel fuel. The amount of emulsifier used was 0.05% based on total volume of emulsion, including fuel and water, for all experiments in Table 1.

The used diesel fuel was a marine diesel oil of the type DMA according to DIN ISO 8217 a clear liquid diesel, free of additive packages and had a density of about 0.83 to 0.85.

The emulsion was prepared with a Silverson L5 high shear lab emulsifier based on rotor-stator principle within 10 sec at 7500 rpm at room temperature.

Then the emulsified samples were put in a graduated cylinder which was allowed to stand for up to 30 min. The amount of separated water phase was determined. For example, if 8 ml separated water phase was detected in the 80 ml total volume sample, it corresponded to an emulsion stability of 90%. If no separated water phase was detected this corresponded to 100% emulsion stability. The values are given in Table 1.

The following surfactants were used:

Short-Chained Surfactants of Formula (I):

Nonionic B: Isotridecanol ethoxylate, 70% active content in water, pour point about 0° C. according to ISO 3016.

Nonionic C: Isotridecanol ethoxylate, 70% active content in water, HLB about 18.

TABLE 1

| Additive Packages (all amounts in wt %) and Emulsion stability (lower part) | | |
|---|---|---|
| Examples | 1 | 2 |
| Water | | |
| Nonionic B | | 100 |

TABLE 1-continued

| Additive Packages (all amounts in wt %) and Emulsion stability (lower part) | | |
|---|---|---|
| Examples | 1 | 2 |
| Nonionic C | 100 | |
| Ratio Fuel:Water | 1:1.4 | 1:1.4 |
| 1 min. | 99% | 99% |
| 2 min. | 99% | 99% |
| 5 min. | 99% | 99% |
| 10 min. | 99% | 99% |
| 20 min. | 98% | 99% |
| 30 min. | 97% | 98% |

It can easily be seen that the short-chained surfactants of the formula (I) are well suitable for stabilising water-fuel-emulsions.

The invention claimed is:

1. A method for powering a diesel engine with a fuel emulsion, the method comprising:

preparing the fuel emulsion by emulsifying a fuel and water in the presence of an emulsifier package which comprises a short-chained surfactant of the formula (I)

$$R^a—O-(AO^a)_m—R^{a'} \quad (I),$$

in which $R^a$ is a branched $C_{8-14}$ alkyl, $AO^a$ is an ethylene oxide radical, propylene oxide radical, butylene oxide radical, pentylene oxide radical, or mixture thereof, m is a number from 1 to 100, and $R^{a'}$ is hydrogen or $C_{1-4}$ alkyl; and wherein the emulsifier package additionally comprises a long-chained surfactant of the formula (II)

$$R^b—O-(AO^b)n-R^{b'} \quad (II),$$

in which $R^b$ is a linear or branched $C_{16-32}$ alkyl, $AO^b$ is an ethylene oxide radical, propylene oxide radical, butylene oxide radical, pentylene oxide radical, or mixture thereof, n is a number from 1 to 100, and $R^{b'}$ is hydrogen or $C_{1-4}$ alkyl.

2. The method according to claim 1, wherein m is a number from 3 to 60.

3. The method according to claim 1, wherein n is a number from 3 to 60.

4. The method according to claim 1, wherein $R^a$ is isotridecyl.

5. The method according to claim 1, wherein $AO^a$ is an ethylene oxide radical.

6. The method according to claim 1, wherein $R^b$ is a linear $C_{16-22}$ alkyl.

7. The method according claim 1, wherein $AO^b$ is a mixture of an ethylene oxide radical and a propylene oxide radical.

8. The method according to claim 1, wherein $R^{a'}$ and $R^{b'}$ are hydrogen.

9. The method according to claim 1, wherein the emulsifier package comprises the short-chained surfactant and the long-chained surfactant in a weight ratio of 10:1 to 1:10.

10. The method according to claim 1, wherein the emulsifier package comprises 1 to 99 wt % of the long-chained surfactant.

11. The method according to claim 1, wherein the emulsifier package comprises 1 to 99 wt % of the short-chained surfactant.

12. The method according to claim 1, wherein the emulsifier package comprises at least 10 wt % of water, an organic solvent, or a mixture of water and an organic solvent.

13. The method according to claim 1, wherein the fuel emulsion comprises the emulsifier package in an amount of 0.05 to 0.4 wt % based on the diesel.

14. The method according to claim 12, wherein the fuel emulsion comprises 40 to 80 wt % water.

15. The method according to claim 1, wherein the fuel is marine fuel.

16. A fuel emulsion for powering a diesel engine, as defined in claim 1.

17. The method according to claim 9, wherein the emulsifier package comprises the short-chained surfactant and the long-chained surfactant in a weight ratio of 4:1 to 1:4.

18. The method according to claim 1, wherein m and n are each independently 3 to 60.

19. The method according to claim 1, wherein $AO^b$ is a mixture of an ethylene oxide radical and a propylene oxide radical in a molar ratio of 50:1 to 1:2.

20. The method according to claim 1, wherein $AO^b$ is a mixture of an ethylene oxide radical and a propylene oxide radical in a molar ratio 10:1 to 1:1.

* * * * *